US007875783B2

(12) United States Patent
Shigenaga

(10) Patent No.: US 7,875,783 B2
(45) Date of Patent: Jan. 25, 2011

(54) SPRING HOLDING MECHANISM FOR FOOT PEDAL OF BASS DRUM

(75) Inventor: Fumihiro Shigenaga, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 12/633,148

(22) Filed: Dec. 8, 2009

(65) Prior Publication Data

US 2010/0170380 A1 Jul. 8, 2010

(30) Foreign Application Priority Data

Jan. 7, 2009 (JP) ..... 2009-001452

(51) Int. Cl.
*G10D 13/02* (2006.01)

(52) U.S. Cl. ..... 84/411 R; 84/422.1

(58) Field of Classification Search ..... 84/422.1, 84/422.2, 422.3, 411 R
See application file for complete search history.

(56) References Cited

U.S. PATENT DOCUMENTS 5,365,824 A 11/1994 Hoshino
6,747,200 B2 * 6/2004 Sato ..... 84/422.3

* cited by examiner

*Primary Examiner*—Kimberly R Lockett
(74) *Attorney, Agent, or Firm*—Dickstein Shapiro LLP

(57) ABSTRACT

A spring holding mechanism is adapted to a foot pedal including a spring which applies a tensile force to a rotation shaft interconnected with a drum beater of a bass drum. It includes an external thread (i.e. a bolt) interconnected to one end of the spring, a support member having a hole allowing for the external thread running therethrough, and an internal thread (i.e. a fixing nut) that is engaged with the external thread so as to fix the support member in position, thus limiting the vertical movement of the external thread in an axial direction. A projection and a recess are formed in the support member and the internal thread respectively. The projection having an external slope is engaged with the recess having an internal slope so that the projection is received inside the recess when the internal thread is attached to the support member.

3 Claims, 3 Drawing Sheets

SPRING HOLDING MECHANISM FOR FOOT PEDAL OF BASS DRUM

BACKGROUND OF THE INVENTION

1. Field of the Invention

The present invention relates to spring holding mechanisms for holding springs attached to rotation shafts interconnecting drum beaters and foot pedals in bass drums.

The present application claims priority on Japanese Patent Application No. 2009-1452, the content of which is incorporated herein by reference.

2. Description of the Related Art

Conventionally, foot pedals (or foot boards) interconnected with drum beaters have been used for bass drum performances, wherein players depress foot pedals to pivotally operate drum beaters, which beat the drumheads of bass drums. Foot pedals and drum beaters are interconnected together via rotation shafts, which are interconnected with springs for imparting tensile forces in a radial direction. When players release foot pedals from being depressed, foot pedals and drum beaters are returned to normal positions due to the tensile force of the springs.

Patent Document 1: U.S. Pat. No. 5,365,824

Patent Document 1 discloses a spring adjustment mechanism for holding one end of a spring opposite to another end interconnected to a rotation shaft. Herein, a bolt is connected to one end of the spring and is inserted into a hole formed in a support frame. The bolt is engaged with a pair of nuts that tightly hold the support frame at both sides in an axial direction of the hole, so that the spring is being held by the bolt being fixed in position.

Patent Document 1 discloses that the contact area between the nuts and the support frame is formed in a horizontal plane perpendicular to the axial line of the bolt; hence, nuts easily get loosened so as to weaken the bolt holding the spring during performance. This causes positional deviation or backlash of the bolt, which in turn causes unwanted noise or which varies the spring that forces the foot pedal and drum-beater to return to their original positions, thus impairing the performing ability of a bass drum.

SUMMARY OF THE INVENTION

It is an object of the present invention to provide a spring holding mechanism for preventing an internal thread (or a nut) from loosening during a performance where a bass drum is beaten by a drum beater interconnected to a drum pedal.

The present invention is directed to a spring holding mechanism adapted to a foot pedal in which a spring applies a tensile force to a rotation shaft interconnected with a drum beater of a bass drum. The spring holding mechanism includes an external thread (i.e. a bolt) interconnected to one end of the spring, a support member having a hole allowing for the external thread running therethrough, and an internal thread (i.e. a fixing nut) that is engaged with the external thread so as to fix the support member in position, thus limiting the vertical movement of the external thread in an axial direction. Herein, a projection and a recess are formed in the support member and the internal thread respectively. The projection having an external slope is engaged with the recess having an internal slope so that the projection is received inside the recess when the internal thread is attached to the support member.

The projection above is shaped like a truncated cone while the internal slope of the recess is shaped to suit the truncated cone.

In addition, the spring holding mechanism further includes a secondary internal thread (i.e. an adjusting nut) that is engaged with the external thread, wherein the support member is tightly held between the internal thread and the secondary internal thread.

Further rotating the internal thread forces the projection (acting like a wedge) to encroach into the recess while the external slope slides along the internal slope. This makes it possible to prevent the external thread (which controls the tensile force applied to the rotation shaft via the spring) from being unexpectedly loosened during performance of the bass drum. Since the spring holding mechanism holds the external thread at the prescribed position, it is possible to maintain the foot pedal at the best position, thus, it is possible to prevent noise and to improve the performance of the bass drum.

BRIEF DESCRIPTION OF THE DRAWINGS

These and other objects, aspects, and embodiments of the present invention will be described in more detail with reference to the following drawings.

DESCRIPTION OF THE PREFERRED EMBODIMENT

The present invention will be described in further detail by way of examples with reference to the accompanying drawings.

Figure 1:
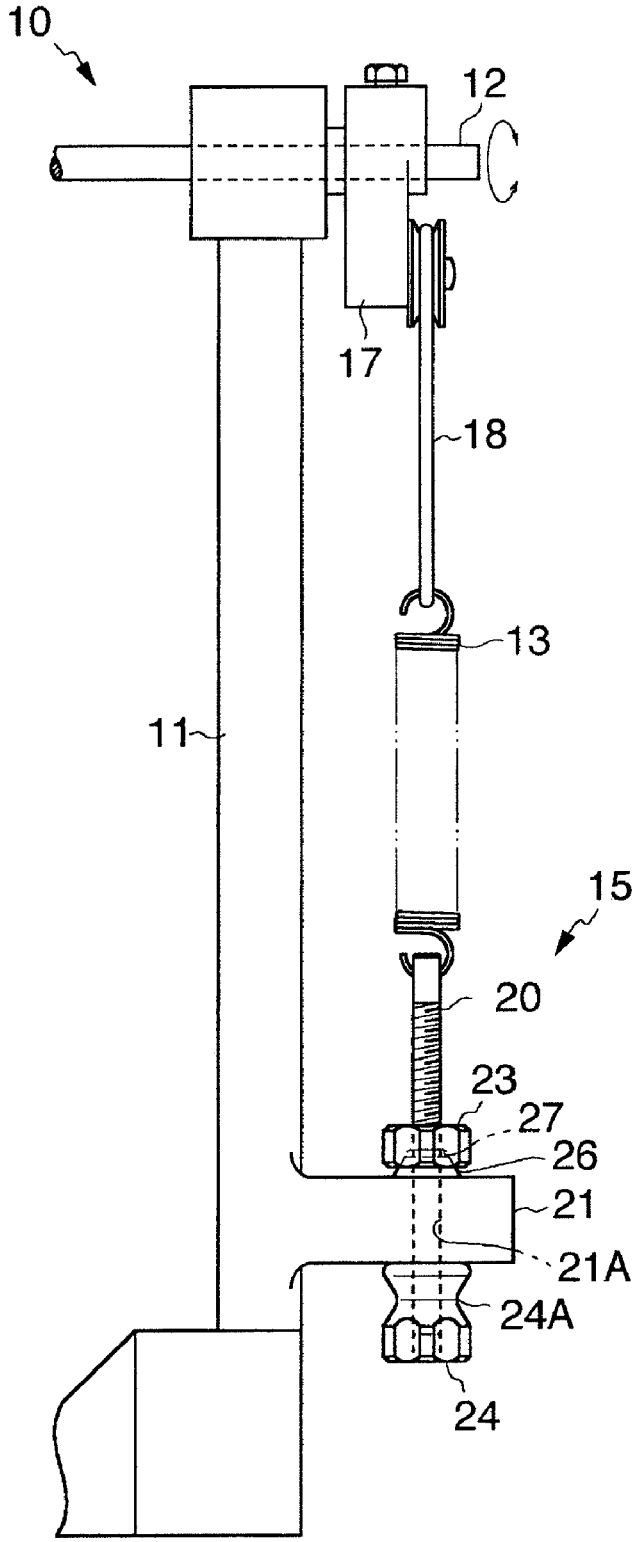
FIG. 1 is a side view showing essential parts of a foot pedal employing a spring holding mechanism according to a preferred embodiment of the present invention.

FIG. 1 is a side view showing essential parts of a foot pedal 10 employing the spring holding mechanism according to a preferred embodiment of the present invention. The foot pedal 10 is constituted of a frame 11 vertically elongated, a rotation shaft 12 pivotally supported by the frame 11, a spring 13 imparting a downward tensile force to the rotation shaft 12, and a holding mechanism 13 holding the lower end of the spring 13.

The rotation shaft 12 is equipped with a foot board and a drum beater (both not shown). Depressing the foot pedal forces the rotation shaft 12 to rotate so as to pivotally operate the drum beater, thus beating a bass drum (not shown). A cam plate 17 is attached to the right-side of the rotation shaft 12. The upper end of the spring 13 is hung and held on the lower portion of the cam plate 17 via a spacer member 18.

Figure 2:
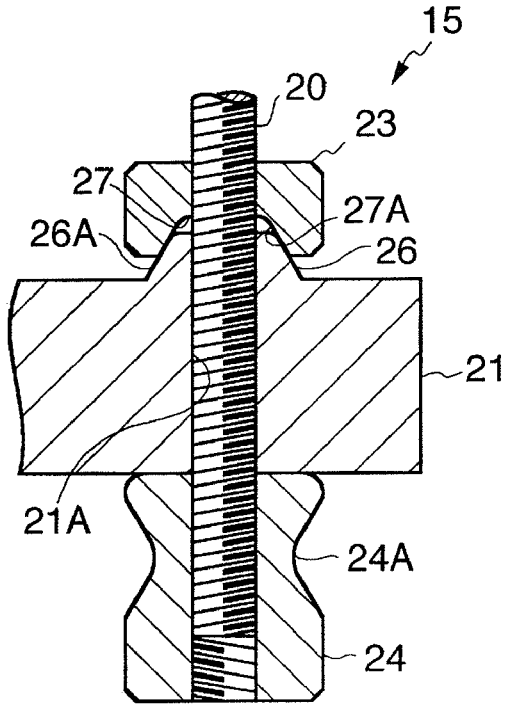
FIG. 2 is a cross-sectional view of a holding mechanism holding a spring in the foot pedal shown in FIG. 1.
Figure 3:
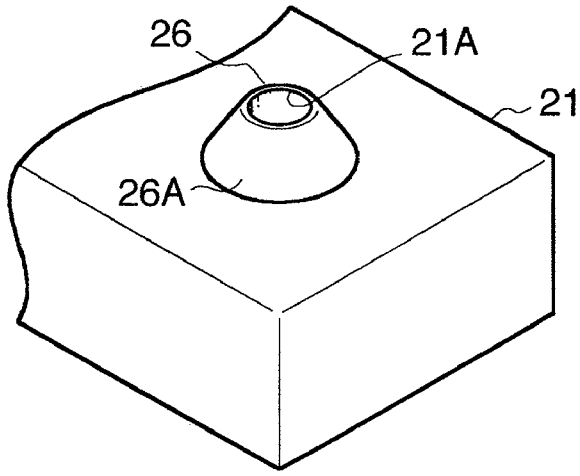
FIG. 3 is a perspective view showing a support member and its projection included in the holding mechanism.
Figure 4:
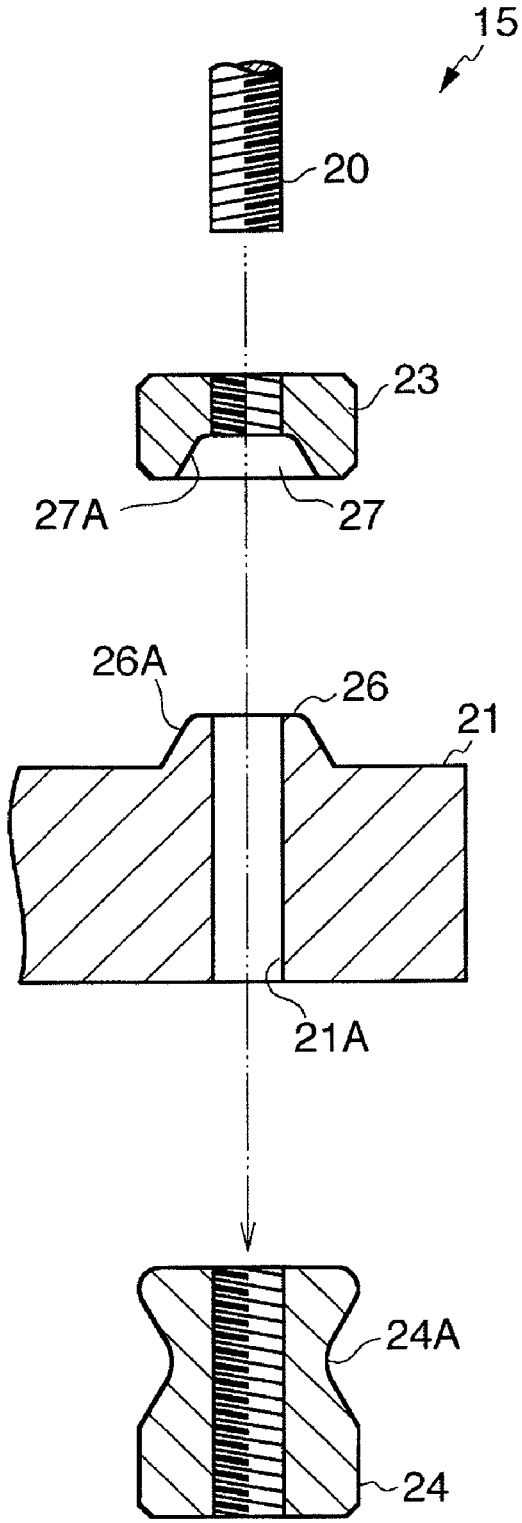
FIG. 4 is an exploded cross-sectional view of the holding mechanism.

As shown in FIG. 2 to FIG. 4, the holding mechanism 15 having a vertically extending ability is constituted of a bolt 20 (i.e. an external thread) interconnected to the lower end of the spring 13, a support member 21 horizontally protruded from the lower portion of the frame 11, and a fixing nut 23 and an adjusting nut 24 (i.e. a pair of internal threads) that engage with the bolt 20. The adjusting nut 24 is shaped with a necking portion 24A in the external portion thereof and is positioned beneath the lower surface of the support member 21.

A hole 21A is formed through the support member 21 to allow for the bolt 20 running therethrough. An upward projection 26 is formed in the periphery of the hole 21A on the upper surface of the support member 21. The upper projection 26 is shaped like a truncated cone whose axial position identifies with the axial position of the hole 21A. The upper projection 26 has a slope (or a conic surface) 26A as the exterior surface thereof, wherein the slope 26A is inclined such that the upper portion thereof approaches the upper edge of the hole 21A in the axial direction thereof.

The fixing nut 23 is positioned on the upper surface of the support member 11, and a recess 27 is formed in the lower portion of the fixing nut 23. The recess 27 is formed in a countersinking shape having an interior slope 27A suited to the slope 26A of the upper projection 26. The internal diameter of the recess 27 is determined to partially receive the distal end of the upper projection 26; hence, when the fixing nut 23 is attached to the support member 21 such that the upper projection 26 is inserted into the recess 27, the slopes 26A and 27A are brought into plane contact with each other.

The holding mechanism 15 is used to hold the lower end of the spring 13 in such a way that the bolt 20 is inserted into the hole 21A of the support member 21 is then engaged with the fixing nut 23 and the adjusting nut 24. In addition, the lower end of the spring 13 is interconnected to the bolt 20, while the upper end thereof is interconnected to the spacer member 18. Subsequently, the adjusting nut 24 is rotated to vertically move along the bolt 20 in the axial direction. Thus, it is possible to adjust the vertical position of the lower end of the spring 13 when the upper surface of the adjusting nut 24 comes in contact with the lower surface of the support member 21. The vertical adjustment expands the spring 13, which in turn pulls the rotation shaft 12 downwardly with an appropriate tensile force, thus maintaining the rotation shaft 12 at the predetermined rotary position.

Then, the fixing nut 23 is rotated so as to approach the support member 21, whereby the recess 27 receives the distal end of the projection 26 therein so that the slopes 26A and 27A come in contact with each other. The support member 21 is tightly held between the fixing nut 23 and the adjusting nut 24, thus limiting the vertical movement of the bolt 20 in the axial direction. When the fixing nut 23 is further tightened on the condition that the recess 27 receives the projection 26 therein, the projection 26 is forced to encroach into the recess 27. This makes it possible to prevent the fixing nut 23 from being unexpectedly loosened.

According to the present embodiment, the fixing nut 23 and the adjusting nut 24 are engaged with the bolt 20 so as to tightly hold the support member 21 therebetween, and further rotating the fixing nut 23 forces the projection 26 (acting like a wedge) to encroach into the recess 27, thus reliably preventing the fixing nut 23 from being unexpectedly loosened. This makes it possible to prevent the backlash of the bolt 20 and to prevent noise from occurring due to the loosening of the fixing nut 23. Thus, it is possible to improve the performance of a bass drum by way of the stabilization of the tensile force applied to the rotation shaft 12.

The present invention is not necessarily limited to the present embodiment, which exemplifies technical features of the foot pedal 10 employing the spring holding mechanism in conjunction with the drawings and which can be rectified in various ways with respect to the shape, position, and arrangement of components without departing from the technological concept and the scope of the invention as defined in the appended claims.

For example, it is possible to modify the holding mechanism 15 such that a downward projection is formed in the lower portion of the fixing nut 23 while a recess for receiving the downward projection is correspondingly formed in the upper portion of the support member 21 surrounding the hole 21A, thus preventing the fixing nut 23 from being unexpectedly loosened.

Similar to the above fixing nut 23, a projection or recess is formed in the upper portion of the adjusting nut 24 while a recess or projection is correspondingly formed in the lower portion of the support member 21.

What is claimed is:

1. A spring holding mechanism adapted to a foot pedal including a spring applying a tensile force to a rotation shaft interconnected with a drum beater of a bass drum, comprising:

an external thread interconnected to one end of the spring;

a support member having a hole allowing for the external thread running therethrough; and an internal thread that is engaged with the external thread so as to fix the support member in position, thus limiting a vertical movement of the external thread in an axial direction, wherein a projection and a recess are formed in the support member and the internal thread respectively, and wherein the projection having an external slope is engaged with the recess having an internal slope so that the projection is received inside the recess when the internal thread is attached to the support member.

2. The spring holding mechanism according to claim 1, wherein the projection is shaped like a truncated cone while the internal slope of the recess is shaped to suit the truncated cone.

3. The spring holding mechanism according to claim 1 further comprising a secondary internal thread that is engaged with the external thread, wherein the support member is tightly held between the internal thread and the secondary internal thread.

* * * * *